United States Patent [19]

Kuniki et al.

[11] Patent Number: 4,703,877

[45] Date of Patent: Nov. 3, 1987

[54] AUTOMATIC HOSE-FITTING APPARATUS

[75] Inventors: Toyomi Kuniki; Satoru Yamaji, both of Yamatotakada, Japan

[73] Assignee: Takatori Machinery Mfg. Co., Ltd., Nara, Japan

[21] Appl. No.: 908,502

[22] Filed: Sep. 17, 1986

[30] Foreign Application Priority Data

Sep. 30, 1985 [JP] Japan ..... 60-218715
Dec. 25, 1985 [JP] Japan ..... 60-201733[U]

[51] Int. Cl.[4] ..... D06C 5/00

[52] U.S. Cl. ..... 223/60; 223/76; 223/112

[58] Field of Search ..... 2/60, 75, 76, 77, 112; 112/121.15

[56] References Cited

U.S. PATENT DOCUMENTS

| | | | |
|---|---|---|---|
| 2,842,298 | 7/1958 | Hill | 223/60 |
| 3,806,009 | 4/1974 | Glaze | 223/112 |
| 4,401,244 | 8/1983 | Selvi et al. | 223/77 X |
| 4,515,299 | 5/1985 | Sewell et al. | 223/76 |
| 4,524,889 | 6/1985 | Glaze | 223/76 |
| 4,611,733 | 9/1986 | Nishikawa et al. | 223/75 |

*Primary Examiner*—Louis K. Rimrodt
*Attorney, Agent, or Firm*—Wenderoth, Lind & Ponack

[57] ABSTRACT

Disclosed is an apparatus for automatically taking off inspected hose from a pattern plate of a hose-inspecting apparatus and fitting them on a pattern plate of a hose-finishing apparatus, to be disposed in the middle of where each one of the inspecting pattern plates and each one of the finishing pattern plates are opposed at a certain interval. The hose-fitting apparatus is constructed substantially of a finger and a pair of levers that serve to make the finger ascend and descend with its position kept upright along a certain eldless track pierced through a pair of plates on both sides of it by means of a pair of belts respectively provided to the plates and a driving means. Thus, in the ascending progress close to the inspecting pattern plate, the finger can remove a pair of hose from it upward getting in from its bottom and, in the descending progress close to the finishing plate, put the hose on it getting out therefrom repeatedly.

5 Claims, 17 Drawing Figures

AUTOMATIC HOSE-FITTING APPARATUS

This invention relates to an apparatus for automatically fitting long hose such as stockings or pantyhose (hereinafter simply referred to hose) on a pattern plate of a hose-finishing apparatus; more particularly, this invention relates to an apparatus for automatically taking off inspected hose from a pattern plate of a hose-inspecting apparatus, taking them to a pattern plate of a hose-finishing apparatus and fitting them on the same pattern plate.

In the hose production process, hose on a sewing machine have to be finished on a pattern plate; for this, a hose-finishing apparatus in workshops is provided with many pattern plates. Accordingly, the automatization of fitting hose on the pattern plates has earnestly been studied in hosiery dealers in order to promote the saving of labor and increase the working efficiency.

Incidentally, a conventional hose-fitting apparatus, automatically fitting hose on a hose-finishing pattern plate, is, as shown in FIGS. 16 and 17, constructed in such a way that when a worker fits a pair of hose on a finger 3 of a circulating member 2, provided to an endless belt 4 circulating along a certain path, opening the mouth of the hose (the part fitted on the waist), a roller 5 tucks up on the finger the dangling leg part of the hose, up to the toe part, in the ascending progress, which is then fitted on a nearby pattern plate 7 of a hose-finishing apparatus 6 in the descending progress so as to spread out the tucked-up leg part.

In such conventional hose-fitting apparatuses, the whole leg part of hose being tucked up as far down as the toe part on the finger 3 and tucks of the leg part being spread on the pattern plate 7, hole fitted on the pattern plate are put in a properly tensed condition, from the waist to the toe part. Therefore, all a worker has to do is take hose to the finger 3, opening the mouth of their waist part; that is, as long as fitting hose on the pattern plate is concerned, anything else is carried out very efficiently by the apparatuses while the endless belt makes a round trip on a given path repeating intermittent stops. Nevertheless, in the conventional hose-fitting apparatus is a problem; that is, a worker taking hose to the finger opening their mouth cannot afford time to inspect the sewn-up hose because their whole leg part, as far down as the toe part, is freely hanging from the finger, which starts to ascend as soon as his/her fitting is over and a roller 5 quickly begins to tuck up the hanging leg part. As seen from this, it used to be impossible for a worker to have a close look at sewn-up hose before finishing, not only because of such mechanical operations inconvenient for inspection but also because of such shortage of time.

For this reason, inspection has so far been made by a separate worker after hose being fitted on a pattern plate 7 of a hose-finishing apparatus or with the aid of a separate proper inspecting apparatus before finishing is started.

As stated above, an extra worker has been required for inspection, in addition to a worker for fitting hose on a finishing-pattern plate; hence, these days the demand for raising the working efficiency and saving the labor cost is on the increase.

Accordingly, it is an object of this invention to provide an automatic hose-fitting apparatus, which enables one worker to cope with a sequence of jobs, from inspecting to fitting sewn-up hose on a finishing-pattern plate. It is another object of this invention to provide an automatic hose-fitting apparatus, which makes it possible to reduce the production cost by the increase in the working efficiency and the reduction in the production cost due to the saving of extra labor. It is still another object of this invention to provide an automatic hose-fitting apparatus, by which a pair of hose fitted on an inspecting pattern plate is well spread so that sufficient inspection can be made exactly and speedily.

The above and other objects and features of the invention will appear more fully hereinafter from a consideration of the following description taken in connection with the accompanying drawing wherein one example is illustrated by way of example.

Figure 1:
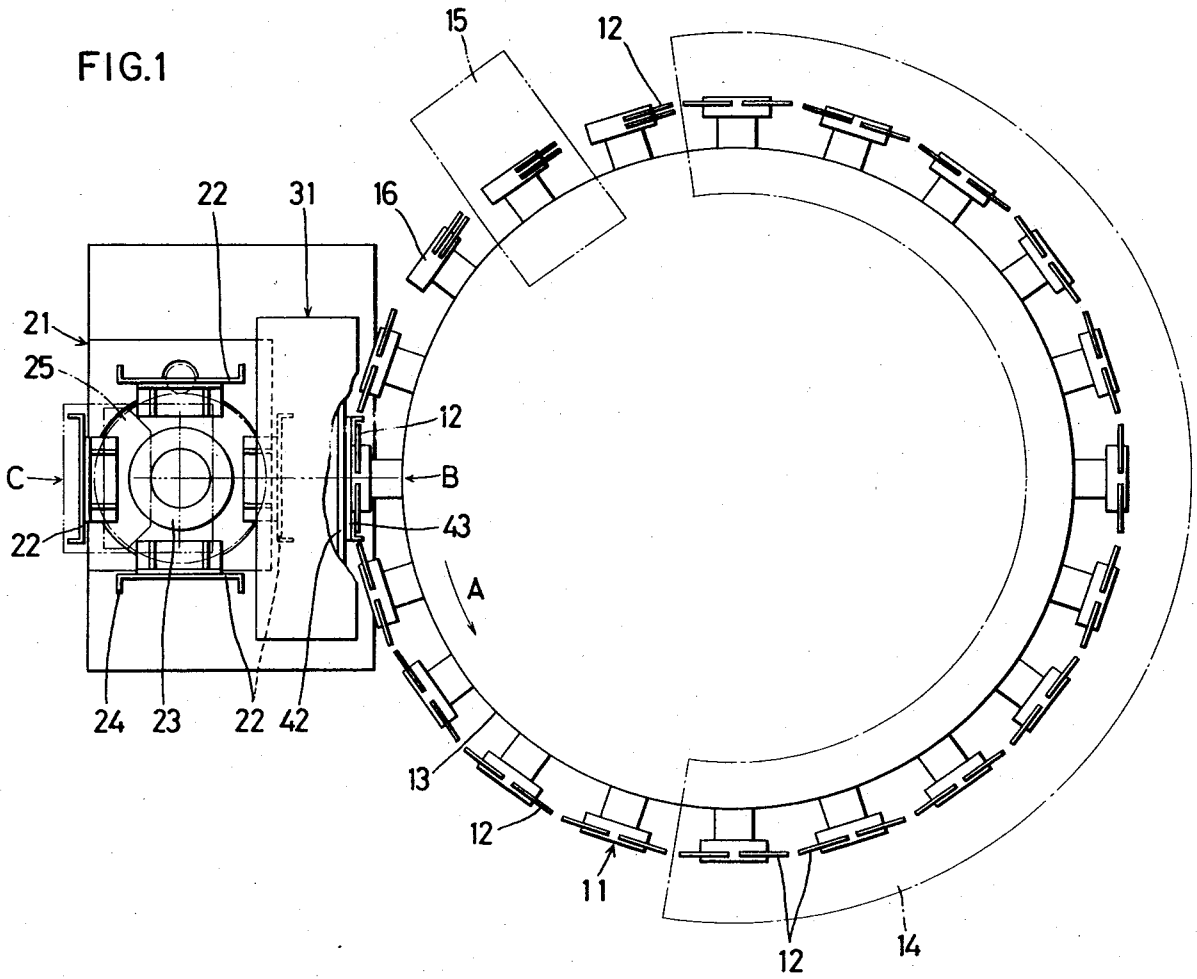
FIG. 1 is a plan view of a hose-fitting apparatus of this invention.
Figure 2:
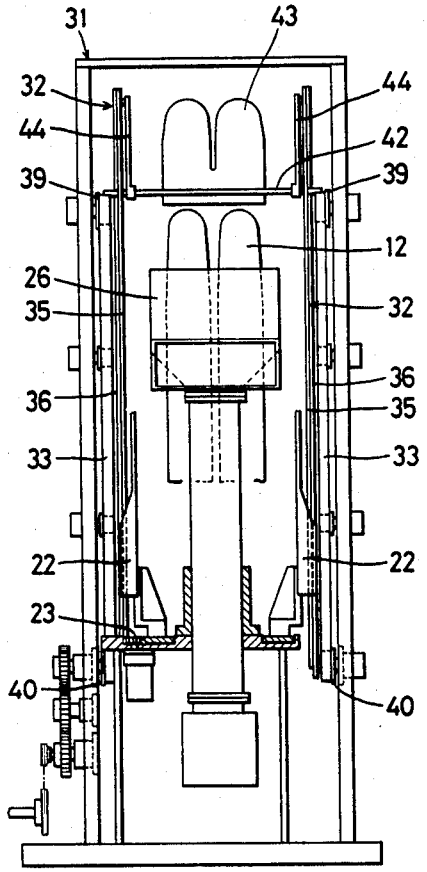
FIG. 2 is a longitudinal cross-sectional elevational view of an essential part of the hose-fitting apparatus in FIG. 1.

A hose-fitting apparatus of this invention is employed in such arrangement as shown in FIG. 1. That is, a hose-inspecting apparatus 21 is disposed beside a hose-finishing apparatus 11 so that the hose-fitting apparatus 31 is located in the space where the pattern plates 12 of the hose-finishing apparatus 11 and the pattern plates 22 of the hose-inspecting apparatus 21 face to each other one to one.

In the hose-finishing apparatus 11, a number of pattern plate 12 to fit hose on are provided on an endless track 13, which intermittently advance toward the arrow-headed direction A, as shown in FIG. 1. On the right of FIG. 1, there is a tunnel-shaped circular encasement 14, through which hose fitted on the pattern plate 12 are allowed to pass, whereby they are dried and heated for finishing. No sooner do they get out of the encasement than they are taken off from the pattern plates 12 by hose-taking off apparatus 15. Each pair of hose undergoes the same process, whereby they are heat-set continuously. The pattern plate 12 for finishing is folded in two over themselves, together with a holder 16, when passing the hose-taking off apparatus, so that the packing of hose can be made readily.

In the hose-inspecting apparatus 21, there are provided four pattern plates 22 on a rotary circular table 23 at right angles to each other, which can intermittently be moved by 90° in a certain direction. The rotary circular table 23 of the hose-inspecting apparatus is constructed such that each one of the hose-inspecting pattern plates 22 can face at a proper interval to each one of the pattern plate 12 of the hose-finishing apparatus 11, which comes to the position B where the fitting of hose is conducted one after another. Meanwhile, the inspecting pattern plate 22 just behind the one facing to the finishing pattern plate 12 is in the position C for inspection at this moment.

Figure 10:
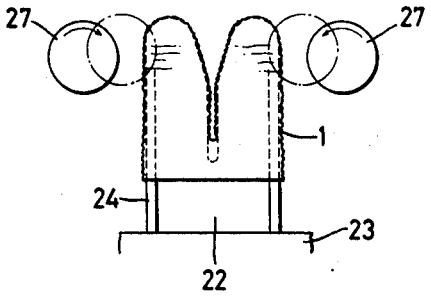
FIG. 10 is an elevational view of a pattern plate for inspection.

In the case of FIG. 10, each of the inspecting pattern plates 22 is made of a transparent material. Both their sides are also provided with longitudinal projections 24 and an illuminating appliance 25 is provided on the opposite side of the pattern plate 22 at the position C in terms of an inspector; therefore, the inspector can have a close look at both sides of hose when they are fitted on the inspecting pattern plates 22.

Disposed just above the inspecting pattern plate 22 stopping at the position C is a suction duct 26, serving to lightly hold the toe part of hose while they are being fitted on the pattern plate 22; the suction is very helpful for a worker to conduct inspection and fitting smoothly. Besides, a pair of rollers 27, 27, capable of being close to or far away from each other, are disposed on both sides of each inspecting pattern plate 22, which serve to hitch up a pair of hose 1 from the suction before the hose are fitted on the pattern plate 22.

The hose-fitting apparatus 31 takes off the tucked-up hose 1 on the inspecting pattern plate 22 upward and then fits them on the finishing pattern plate 12 stopping at the position B so as to cover with them. The hose-fitting apparatus 31 comprises a couple of plates 32, 32, vertically disposed between the inspecting pattern plate 22 and the finishing pattern plate 12 to be opposed, a couple of endless belts 33, 33, disposed outside the plates 32, 32 and hose-fitting member 34, disposed between the endless belts 33, 33.

Each of the plates 32, 32 is constructed of combined two plates 35, 36. A length of vertically elongated endless track 37 is provided on the plates 32, 32 so as to pierce them 35, 36 through together. Outside the plates 32, 32 are a couple of stays 38, 38, each of which has two pulleys 39, 40 in the upper and lower parts thereof to guide over the endless belts 33, 33; therefore, the belts 33, 33 are moved parallel to the endless track 37, 37 in the arrowheaded direction D, as shown in FIG. 3, when the lower pulleys 40 are driven by a motor.

The hose-fitting member 34 is disposed between the endless belts 33, 33. The lower end thereof is provided with a fixed shaft 41, which is rotatably inserted into a pipe 42. Both the ends of the fixed shaft 41 are fixed to the endless belts 33, 33, passing through the tracks 37, 37; therefore, both portions on the fixed shaft nearby that ends are put in the tracks 37, 37. The pipe 42, fitted on the fixed shaft 41, can thus travel along the endless track 37 when the endless belts 33, 33 go round. A finger 43 for putting on or taking off hose is fixed to the center of the pipe 42 and a pair of levers 44, projecting in the same direction as the finger does, are also fixed to the pipe 42 near both its ends. The structure being such that the finger 43 and the levers 44 can freely swing centering around the fixed shaft 41, if they are left as they are.

A groove cam 45, part of which shares part of the endless track 37, is provided on the inside plates 35, 35 of the double-plied plates 32, 32. A cam roller 46, attached to each end of the levers 44, 44, is engaged with the groove cam 45 and serves to control the swinging motion of the finger 43, when the finger 43 ascends and descends.

Figure 3:
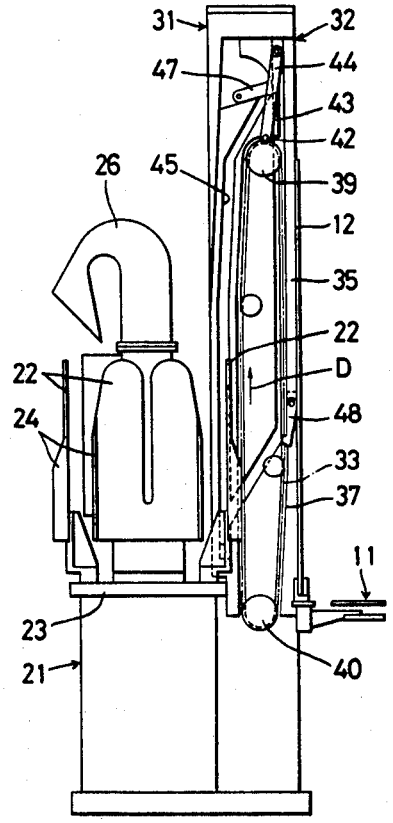
FIG. 3 is a longitudinal cross-sectional side view of an essential part of the hose-fitting apparatus in FIG. 1.
Figure 5:
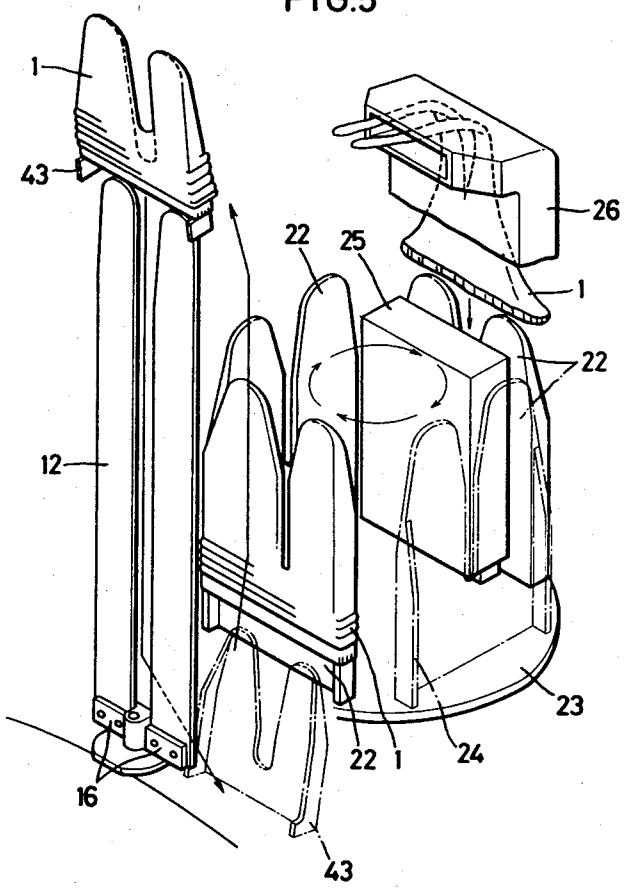
FIG. 5 is a perspective view of an essential part of the hose-fitting apparatus in FIG. 1.
Figure 4:
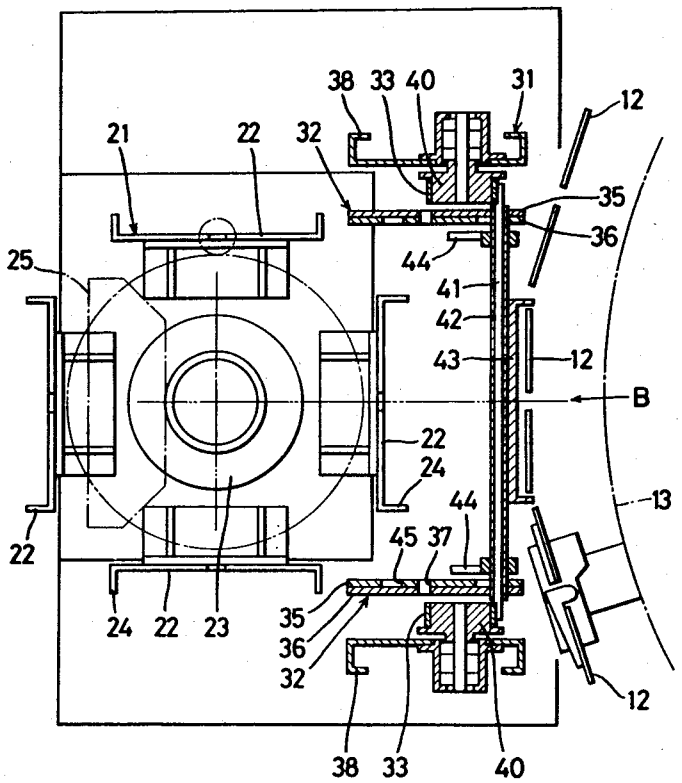
FIG. 4 is an enlarged horizontal cross-sectional view of an essential part of the hose-fitting apparatus in FIG. 1.
Figure 8:
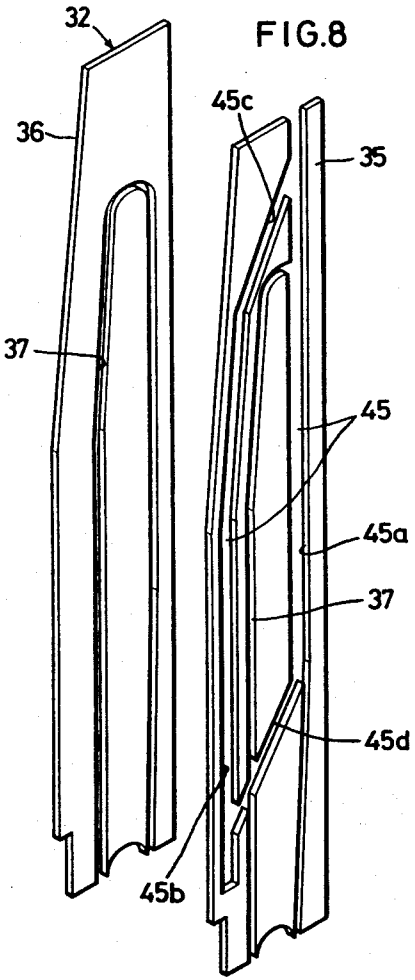
FIG. 8 is a perspective view of side plates, taken off from the hose-fitting apparatus.
Figure 9:
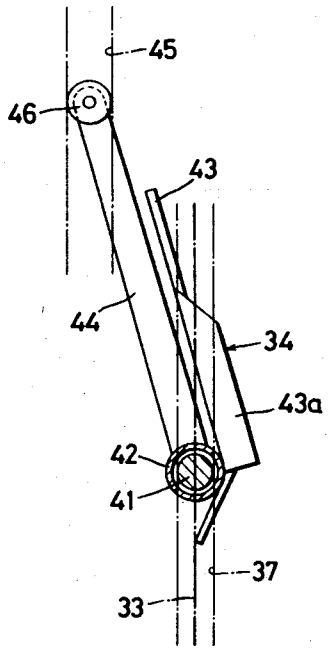
FIG. 9 is an enlarged cross-sectional side view showing the spatial relation between a finger and levers of the hose-fitting apparatus.
Figure 7:
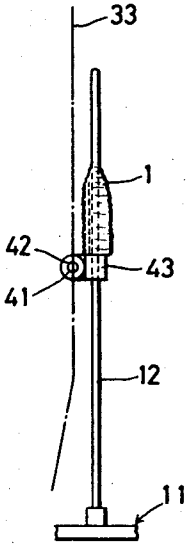
FIG. 7 is a side view of the portion shown in FIG. 6.
Figure 6:
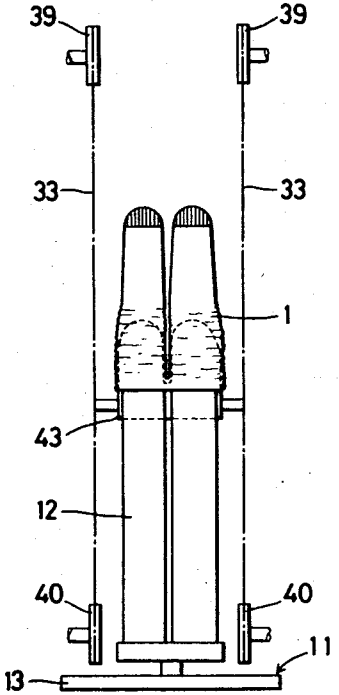
FIG. 6 is a front view showing the spatial relation between the hose-fitting apparatus and a hose-finishing apparatus.

The groove cam 45, as shown in FIGS. 3 and 8, shares part of its path **45*a* with the endless track 37 on the right and extends upward. Part of its path 45*b* vertically runs on the left of the left side track 37. The inclined upper part of its path 45*c*, connects the upper part of the left side straight path 45*b* and the upper part of the right side straight path 45*a*. The inclined lower part of the path 45*d* connects the lower part of the left side straight path 45*b* and the lower part of the right side straight path 45*a***. In consequence, the groove cam is formed into a loop like parallelogram.

As shown in FIG. 3, the finger 43 and the levers 44, 44, both the outsides of which are provided with a couple of flanges **43*a*, 43*a*, project toward the same direction from the outside of the pipe 42. While the lower end of the finger 43 travels along the endless track 37, the top of the levers travels along the groove cam 45, whereby the hose-fitting member 34 can go round on the endless track 37 with the finger 43 kept standing upright. The upper and lower ends of the groove cam 45 are provided with levers 47, 48 so that the cam rollers 46, 46** can go round in the track smoothly.

When the finger 43 ascends from the lowest position, it travels so close to the inspecting pattern plate 22 of the hose-inspecting apparatus 21 that it can get in a pair of hose, tucked up on the pattern plate 22, from the bottom and take the hose off from the pattern plate 22 upward with their tucks remaining as they are. When the finger 43 descends from the highest position, it also travels so close to the finishing pattern plate 12 of the hose-finishing apparatus 11 stopping at the position B that it can fit the hose 1 on the pattern plate 12 from the top and spread tucks of the hose downward over the pattern plate 12. And when the hose 1 are completely fitted on the pattern plate 12, the finger 43 gets out of the hose 1 and turns to the ascending travel.

Figure 11:
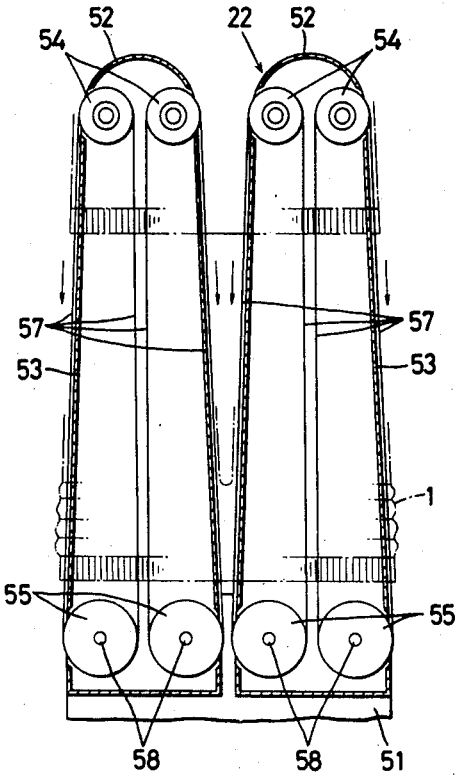
FIG. 11 is an elevational view of another type of pattern plate for inspection.
Figure 15:
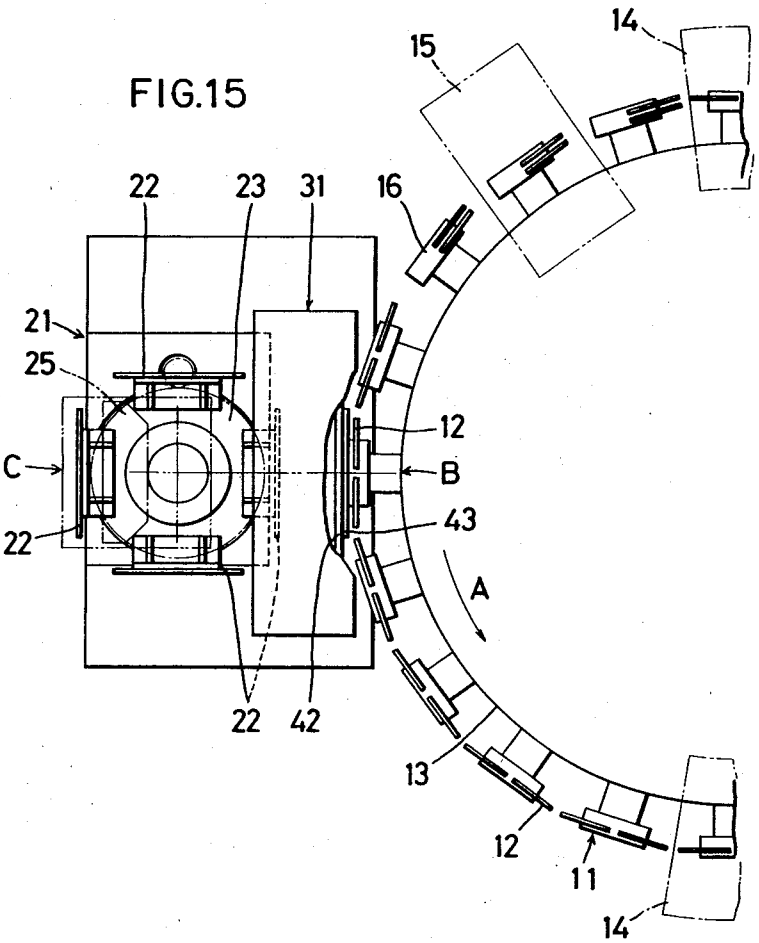
FIG. 15 is a plan view showing the spatial relation between the hose-fitting apparatus and the hose-finishing apparatus in the arranged condition.

FIGS. 11 and 15 show another example of an inspecting pattern plate 22 provided to the hose-inspecting apparatus 21. The pattern plate 22 can automatically spread hose over itself by the following mechanism; therefore, it can save man power required for fitting and facilitate visual inspection; moreover, it can automatically take off a pair of hose if the hose should be found to be defective.

Figure 12:
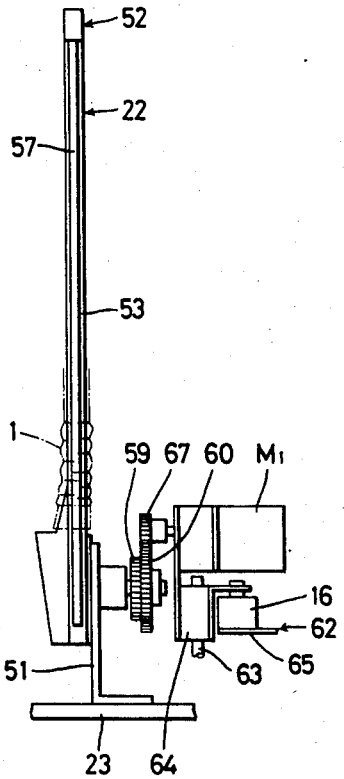
FIG. 12 is a side view of the pattern plate in FIG. 11.
Figure 13:
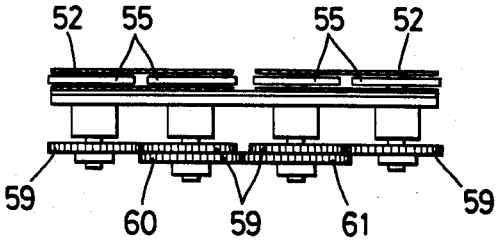
FIG. 13 is a horizontal cross-sectional view of the pattern plate in FIG. 11.

The inspecting pattern plate 22 of the second example is, as shown in FIGS. 11 and 12, constructed essentially of a mounting metal base 51 and a pair of transparent hose-fitting plates 52, 52 standing upright. The hose-fitting plates 52, 52 have the same structure; that is, they are vertically elongated in shape; their top is circular; they are flat and hollow; and they stand side by side at a certain interval so that their flat surface forms a plane in association. An opening 53 is provided on their outer sides.

Inside each of the hose-fitting plates 52, 52, there are a couple of pulleys 54, 54 on both sides of their upper part and another couple of pulleys 55, 55 on both sides of their lower part; endless belts 57, 57 are looped around a couple of opposing pulleys 54, 55 and 54, 55. As shown in FIG. 11, gentle project is provided to the opening 53 on the outer side of the endless belts 57, 57; therefore, part of the endless belts 57, 57 exposed from the opening serves to push down or push up a pair of hose fitted on the hose-fitting plates 52, 52.

The pulleys 55, 55, fixed to the lower part of each of the hose-fitting plates with bearing shafts 58, 58, mesh with gearwheel 59, 59 fixed to the bearing shafts 58, 58, so that each of the pulleys can rotate in the opposite direction. Additionally, the inner two pulleys 55, 55 are jointly rotated by means of engaged gearwheels 60, 61 fixed to the bearing shafts 58, 58; therefore, the endless belts 57, 57 on the hose-fitting plates 52, 52 can rotate in a synchronous manner, as shown by arrow-headed marks in FIG. 11.

Four inspecting pattern plates 22 are disposed on the rotary circular table 23 of the hose-inspecting apparatus 21 at right angles with each other. Therefore, they are designed to revolve between where hose are inspected and where they are received by the hose-finishing apparatus 11, as the table 23 rotates 90° by 90° intermittently.

Figure 14:
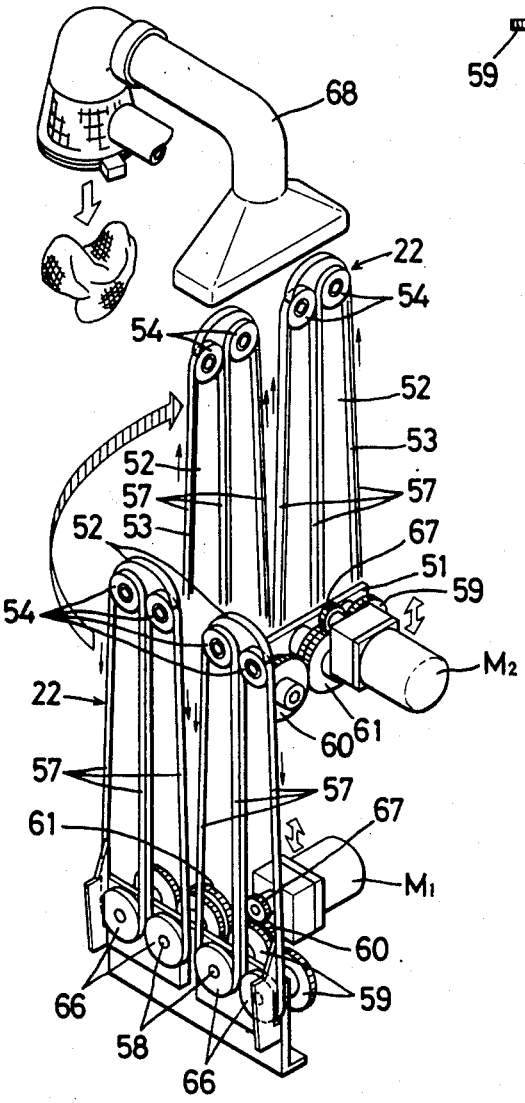
FIG. 14 is a perspective view of the pattern plate in FIG. 11 in operation.
Figure 17:
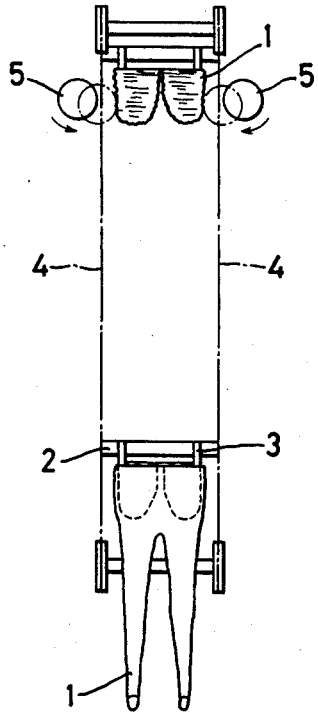
FIG. 17 is a front view of the conventional hose-fitting apparatus.
Figure 16:
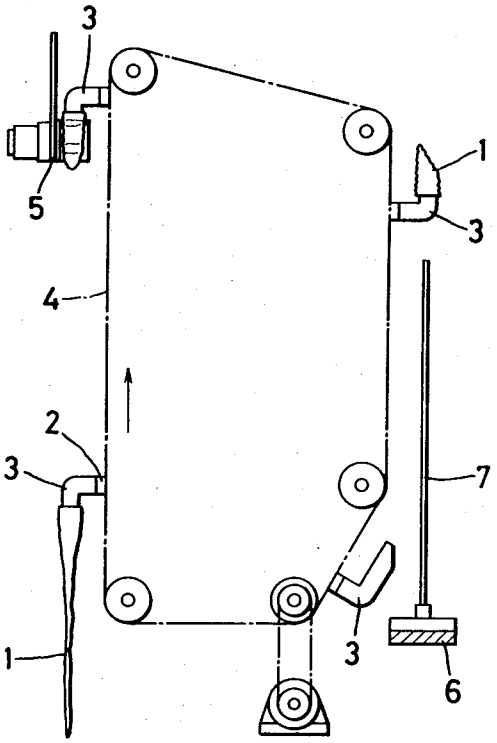
FIG. 16 is a side view of a conventional hose-fitting apparatus.

As shown in FIG. 14, a motor $M_1$ is disposed at the hose inspection position C so as to be able to couple with the gearwheel 60 of the inspecting pattern plate 22 stopping there for inspection in order to hitch down hose by means of the endless belts 57, 57; in addition, a motor $M_2$ is disposed between the hose inspection position C and the hose-fitting position B so as to be able to couple with the gearwheel 61 of the inspecting pattern plate 22 in order to take out defective hose by means of the endless belts 57, 57. Since supporting members 62, 62 for both the motors $M_1$ and $M_2$ have the same structure, the same numerals are to be applied to the equivalent parts for further description.

As shown in FIG. 12, the supporting member 62 for the motor $M_1$ or $M_2$ is secured to a bracket 64 slidable up and down on a vertically fixed shaft 63. A cylinder 66 is disposed between the slidable bracket 64 and a fixed base 65. Thus, the motor $M_1$ or $M_2$ is lifted or lowered by handling the cylinder 66. A gearwheel 67, attached to the output shaft of the motor, is designed to separate from the gearwheel 60 or 61 so as not to hinder the rotational movement of the inspecting pattern plate 22 when the motor $M_1$ or $M_2$ is lifted. The gearwheel 67 is coupled with the gearwheel 60 or 61 when the motor $M_1$ or $M_2$ is lowered, so that the endless belts 57, 57 can go around the pulleys 54 and 55 by the motor $M_1$ or $M_2$.

The hose-inspecting apparatus employing the pattern plate of the second example has such structure that when the inspecting pattern plate stops at the hose inspection position C by the intermittent rotational movement of the rotary circular table 23, the motor $M_1$ is lowered by the contraction of the cylinder 66 and the shaft 67 of the motor $M_1$ meshes with the gearwheel 60. The endless belts 57, 57 begin to go around the pulleys 54, 55 as shown by arrowheaded marks in FIG. 11, concurrently with the start of the motor $M_1$. A pair of hose 1 is put on the hose-fitting plates 52, 52 from the opened waist part. The endless belts 57, 57 hitch down the hose 1 and fit it on the hose-fitting plates 52, 52 as shown in FIGS. 11 and 12. At this moment, a worker can inspect the hose being pushed down in an automatic fashion with his/her own eyes. When the inspection is over, the cylinder 66 extends so as to lift the motor $M_1$ to the top position. When the gearwheel 67 separates from the gearwheel 60, the rotary circular table 23 makes a quarter rotation around its axis in order to forward the inspecting pattern plate 22 to the next stop. If the inspected hose 1 is good, then the supporting member 62 is not actuated and the hose is forwarded to the position B to be received by the pattern plate 12 of the hose-finishing apparatus 11. If, however, the inspected hose 1 is found to be defective, then the cylinder 66 contracts so as to lower the motor $M_2$ as a worker switches on the supporting member 62;.the gearwheel 67 is engaged with the gearwheel 61, and this makes the endless belts 57, 57 reversely go and tucks up the hose 1 in order to take it off from the inspecting pattern plate 22. Meanwhile, the taken-off hose is sucked by means of a suction duct 68 just above the inspecting pattern plate 22 and carried away to a given place.

As stated above, the hose-fitting apparatus of this invention is constructed such that when a worker standing at the inspection position C fits a pair of hose on an inspecting pattern plate 22 of the hose-inspecting apparatus 21 opening the mouth of the hose and gets through with the inspection for the spread hose, the rotary circular table 23 rotates by 90° and there comes the next inspecting pattern plate 22 to put another pair of hose on in front of the worker. When the pattern plate 22, covered with the hose 1, arrives at the position B where the pattern plate 12 of the hose-finishing apparatus 11 is waiting for receiving the hose 1, the finger 43 in the upright position starts to ascends from the bottom position and gets in the tucked up hose in the ascending progress to take it off from the inspecting pattern plate 22 upward.

When the finger 43 gets to the top position, keeping its upright position, it begins to descend alongside the pattern plate 12 of the hose-finishing apparatus 11 with its upright position kept. Therefore, the hose 1 is put on the finishing pattern plate 12 in the descending progress. Since the top of the pattern plate 12 butts against the inside of the toe part, the hose 1 is spread from the toe part and well fitted on the pattern plate 12 automatically. The finger 43 is withdrawn from the hose and turns to the ascending movement in order to receive next hose. The hose-finishing apparatus 11 makes a one-pitch advance on its circular track each time the hose 1 is fitted on the pattern plate 12 in order to forward next pattern plate, not covered with a pair of hose, to the position B, thereby the hose on the pattern plate are allowed to pass through the tunnel-shaped encasement 14 to be given desired heat-set, withdrawn from the pattern plate at the hose-taking off apparatus 15 and packed there right away.

As stated above, according to this invention, the visual inspection of hose on the inspecting pattern plate 22 of the hose-inspecting apparatus 21 and the fitting of hose on the pattern plate 12 of the hose-finishing apparatus 11 can be accomplished by only one worker.

We claim:

1. An apparatus for automatically fitting hose on a pattern plate of a hose-finishing apparatus from a pattern plate of a hose-inspecting apparatus, which is characterized in that said hose-inspecting apparatus is disposed so that at least each one of the pattern plates of said hose-inspecting apparatus can face to at least each one of the pattern plates of said hose-finishing apparatus at an appropriate interval, a pair of plates on which an endless track is provided are disposed on both sides of said opposing pattern plates, a hose-fitting member is disposed between a pair of endless belts that go round in a certain direction along said endless track, said hose-fitting member is constructed of a fixed shaft horizontally spanning said endless belts, a pipe fitted on said fixed shaft so as to be freely rotatable thereon, a finger secured to said pipe, serving to take off hose from said pattern plate of said hose-inspecting appratus in the ascending progress by way of said endless track and fitting hose on said pattern plate of said hose-finishing apparatus in the descending progress by way of said endless track and a pair of levers secured to said pipe together with said finger, freely swingable centering around said fixed shaft in association with said finger, and a groove cam to control the swinging movement of said finger with is provided on said plates to receive and guide a cam roller provided to each end of said levers.

2. A hose-fitting apparatus according to claim 1, in which each of said pattern plates of said hose-inspecting apparatus and of said hose-finishing apparatus is shaped into a double-forked plate for fitting hose thereon and said finger is shaped into a double-forked form to get in the leg part of hose.

3. A hose-fitting apparatus according to claim 1, in which each of said plates on both sides of opposing pattern plates is constructed of combined two plates, said endless track being pierced through said combined plates together and said groove cam being pierced through only inside one of said combined plates so as to overlap part of itself with part of said endless track, said fixed shaft whose two ends pass through said plates horizontally spans said endless belts disposed outside said plates parallel to said endless track, said finger and a couple of said levers are fixed to said pipe which is fitted on said fixed shaft and engaged in said endless track, said cam roller provided to one end of said levers is engaged in said groove cam in order to control the swinging movement of said finger in the ascending and descending progress.

4. A hose-fitting apparatus according to claim 1, in which said pattern plates of said hose-inspecting apparatus are constructed of a hollow, vertically elongated, flat double-forked plate with an oPening on both sides, a couple of pulleys are provided in the upper and the lower parts of each one of said double-forked plates, part of said outer endless belts looped around each pair of upper and lower pulleys is exposed to outside through said opening, each couple of lower pulleys are designed to rotate in the reverse directions by the engagement with gearwheels and a motor and gearwheels are provided to shafts of lower pulleys in order for said endless belts to be driven thereby.

5. A hose-fitting apparatus according to claim 4, in which a pair of hose-fitting plates are placed in line with each other so as to form one plane, said pulleys and said endless belts are built in said hose-fitting plates and said gearwheels for driving said endless belts are engaged with each other in the lower part of said hose-fitting plates.

* * * * *